US009928972B1

(12) United States Patent
Ou et al.

(10) Patent No.: US 9,928,972 B1
(45) Date of Patent: Mar. 27, 2018

(54) LIMIT SWITCH HOUSING WITH RESET FUNCTION

(71) Applicant: Honeywell International Inc., Morris Plains, NJ (US)

(72) Inventors: Xingjun Ou, Nanjing (CN); Keyong Zhou, Nanjing (CN); Honggui Shuai, Nanjing (CN)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/347,024

(22) Filed: Nov. 9, 2016

(51) Int. Cl.
*H01H 3/16* (2006.01)
*H01H 9/02* (2006.01)

(52) U.S. Cl.
CPC ..... *H01H 3/16* (2013.01); *H01H 9/0264* (2013.01); *H01H 2235/01* (2013.01)

(58) Field of Classification Search
CPC ..... H01H 3/16; H01H 3/46; H01H 2012/287; H01H 21/28; H01H 21/285
USPC ..... 200/47
See application file for complete search history.

(56) References Cited

U.S. PATENT DOCUMENTS 3,602,681 A * 8/1971 Finke ..... H01H 21/285 200/339
5,028,748 A * 7/1991 Sakamoto ..... H01H 21/285 200/332
6,483,058 B2 11/2002 Ehrensberger
8,816,226 B2 * 8/2014 Zhou ..... H01H 21/285 200/47
9,697,960 B2 * 7/2017 Tsukimori ..... H01H 3/42
2014/0326586 A1 * 11/2014 Tsukimori ..... H01H 9/02 200/47

FOREIGN PATENT DOCUMENTS

EP 1876616 A2 1/2008

OTHER PUBLICATIONS

"Miniature Manual Reset Limit Switch D4N-R", Product Brochure, Omron Corporation, http://www.omronkft.hu/pdf_en/d4n_r_pdf, downloaded from the internet Nov. 9, 2016, pp. 1-16.
"MAC-1 Safety Switches", Installation Instructions, Panasonic, Aug. 24, 2012, pp. 1-3.

* cited by examiner

*Primary Examiner* — Vanessa Girardi
(74) *Attorney, Agent, or Firm* — Conley Rose, P.C.

(57) ABSTRACT

Embodiments relate generally to a limit switch comprising a switch housing; a contact block assembly comprising a contact plunger and a switch circuit; a head assembly comprising a lever; a reset plunger configured to fit within the housing, configured to interact with the head assembly and the contact plunger; and a reset assembly comprising a reset button and a reset axis, configured to attach to the housing and to interact with the reset plunger, wherein the head assembly moves the reset plunger downward against a bias, wherein, when the reset plunger is moved down a predetermined amount, the reset axis moves into an opening in the reset plunger, due to a bias on the reset axis, wherein when the reset plunger moves downward, the contact plunger also moves downward against a bias, and wherein the contact plunger is configured to control the switch circuit.

20 Claims, 8 Drawing Sheets

LIMIT SWITCH HOUSING WITH RESET FUNCTION

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Limit switches may be used in a number of applications for measuring physical movement of an object or objects. The limit switch may include a portion designed to contact the object to detect the movement via physical contact. Additionally, the limit switch may comprise an indicator for a particular detection, such as an alarm or alert when a certain movement is detected. Limit switches may be used in control systems, compliance detection systems, safety interlock systems, counting objects passing a point, and determining the presence or absence, passing, positioning, and end of travel of an object.

SUMMARY

In an embodiment, a limit switch may comprise a switch housing; a contact block assembly configured to fit within the switch housing, comprising a contact plunger and a switch circuit; a head assembly comprising a lever, configured to attach to the switch housing; a reset plunger configured to fit within the housing, configured to interact with the head assembly and the contact plunger; a reset assembly comprising a reset button and a reset axis, wherein the reset assembly is configured to attach to the housing, and wherein the reset axis is configured to interact with the reset plunger, wherein when the lever rotates with respect to the switch housing, a shaft within the head assembly moves the reset plunger downward against a bias, wherein when the reset plunger is moved down a predetermined amount, the reset axis moves into an opening in the reset plunger, due to a bias on the reset axis, wherein when the reset plunger moves downward, the contact plunger also moves downward against a bias, and wherein the contact plunger is configured to control the switch circuit based on the location of the contact plunger within the contact block.

In an embodiment, a method for operating a limit switch may comprise assembling a reset plunger into a housing of the limit switch, between a head assembly of the limit switch and a contact block of the limit switch, wherein the reset plunger interacts with a contact plunger of the contact block; attaching a reset assembly to the housing, wherein the reset assembly interacts with the reset plunger; rotating a shaft of the head assembly to measure physical motion of an object through physical contact between the shaft and the object; moving the reset plunger downward against a bias due to the rotation of the shaft; moving the contact plunger downward against a bias due to the downward movement of the reset plunger; controlling a switch circuit based on the movement of the contact plunger; when the reset plunger is moved downward a predetermined amount, locking the reset plunger in place via the interaction between the reset assembly and the reset plunger; actuating the reset plunger to move upward by pulling the reset assembly away from the reset plunger; moving the reset plunger upward based on the bias; moving the contact plunger upward based on the bias; and controlling the switch circuit based on the movement of the contact plunger.

In an embodiment, a limit switch may comprise a housing comprising a threaded opening; a contact block assembly configured to fit within the housing, comprising a contact plunger and a switch circuit; a reset assembly comprising a reset button, a reset axis, and a threaded attachment, wherein the reset assembly is configured to attach to the switch housing via the threaded attachment and the threaded opening; a head assembly comprising a shaft, configured to attach to the switch housing; and a reset plunger configured to contact the shaft and the contact plunger, wherein when a measurement is made by the limit switch, the shaft rotates with respect to the switch housing, moving the reset plunger downward against a bias, wherein when the reset plunger is moved downward a predetermined amount, the reset axis moves into an opening in the reset plunger, due to a bias on the reset axis, wherein when the reset plunger moves downward, the contact plunger also moves downward against a bias, wherein the contact plunger is configured to control the switch circuit based on the location of the contact plunger within the contact block, and wherein when the reset button is pulled by a user, the reset axis is removed from the opening in the reset plunger, thereby releasing the reset plunger and the contact plunger to move upward due to the biases.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
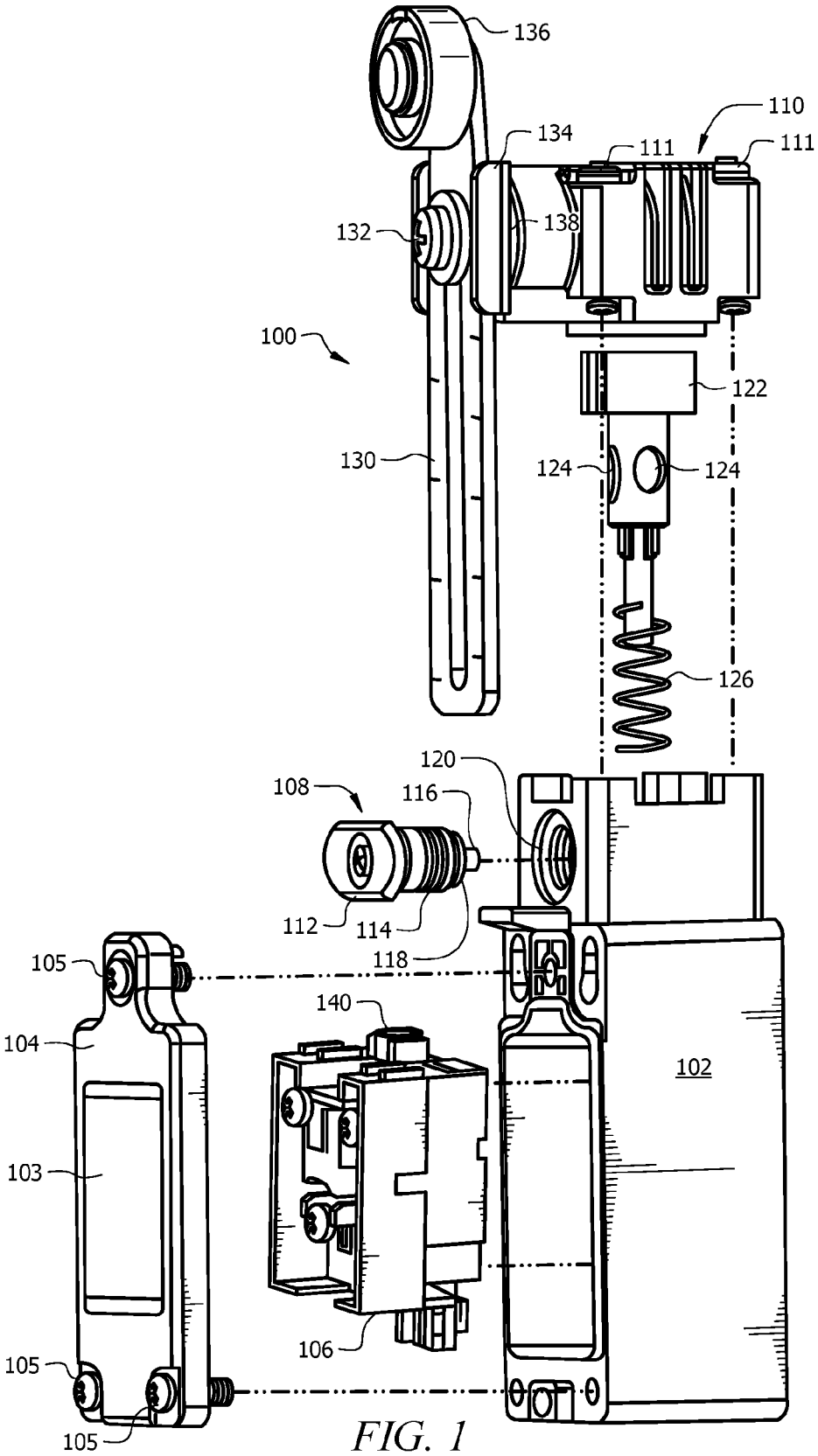
FIG. 1 illustrates an exploded view of a limit switch according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments of the disclosure include systems and methods for providing a reset assembly for use with a limit switch, where the reset assembly comprises a simplified construction.

Typical limit switches with a reset function comprise a separate reset assembly component that is attached to a housing of the limit switch. The attachment creates an interface between the housing and the reset assembly that must be sealed to prevent external particles from entering the housing and damaging the device. The separate reset assembly component may comprise a plurality of parts that are assembled before attaching the reset assembly to the housing.

Embodiments of the disclosure may include a reset assembly configured to attach directly to the housing of the limit switch. Also, the number of components required for the reset assembly may be reduced. The reset assembly may interact with a reset plunger within the housing, wherein movement of the reset plunger may control a switch circuit of the limit switch. Additionally the position and orientation of the reset assembly may be maintained by the attachment with the housing, allowing for easy access for a user to control the reset assembly.

Referring now to FIG. 1, an exploded view of a limit switch 100 is shown. The limit switch 100 may comprise a housing 102, a cover assembly 104, a contact block assembly 106, a reset assembly 108, and a head assembly 110. The cover assembly 104 may attach to the housing 102 via screws 105, and may enclose the contact block assembly 106 within the housing. In some embodiments, the cover assembly 104 may comprise a user interface 103, such as a screen, display, and/or buttons.

In the embodiment shown in FIG. 1, the reset assembly 108 may comprise a reset button 112, a threaded attachment 114, a reset axis 116, and a sealing ring 118. The threaded attachment 114 may be configured to thread into an opening 120 of the housing 102, thereby connecting the reset assembly 108 to the housing 102. In some embodiments, the limit switch 100 may comprise a reset plunger 122 located within the housing 102 and contacting at least a portion of the head assembly 110. The reset plunger 122 may comprise one or more openings 124 configured to interact with the reset axis 116 of the reset assembly 108. Additionally, the reset plunger 122 may interact with a plunger spring 126 to provide a bias on the reset plunger 122.

When assembled, the reset assembly 108 may be located at least partially within the housing 102. The limit switch 100 may not comprise a separate reset housing for the reset assembly 108. The reset assembly 108 may attach directly to the housing 102 of the limit switch 100.

The head assembly 110 may attach to the housing 102 via screws 111. The head assembly 110 may comprise an adjustable lever 130 and a lever screw 132 configured to attach the adjustable lever 130 to the head assembly 110. The head assembly 110 may also comprise a bush 134, a roller 136 attached to the lever 130, and a shaft 138 attached to the lever via the lever screw 132. The shaft 138 may be configured to move within the head assembly. The shaft 138 may be configured to contact the reset plunger 122.

In some configurations, the reset button 112 may be covered by a portion of the head assembly 110, such as the lever 130. In some embodiments, the reset button 112 may comprise an elongated shape allowing a user to access the reset button 112 around the lever 130. In some embodiments, the position of the reset button 112 may be maintained by the attachment between the reset assembly 108 and the housing 102.

The contact block assembly 106 may comprise a contact plunger 140 configured to interact with the reset plunger 122. The contact block assembly 106 may be fixed within the housing, and the contact plunger 140 may contact a portion of the reset plunger 122.

As described above, a typical limit switch may comprise a separate housing for the reset assembly 108. When a separate reset assembly housing is used, there exists attachment interfaces between the housing, reset assembly housing, and the head assembly. These interfaces may be sealed to prevent particles from the external environment from entering the housing.

In the embodiment shown in FIG. 1, the attachment interfaces have been reduced by incorporating the reset assembly 108 directly into the housing 102. There is an attachment interface between the head assembly 110 and the housing 102. But the attachment interface between the reset assembly 108 and the housing 102 has been reduced to the smaller opening 120 that is sealed by the sealing ring 118 of the reset assembly 108. Additionally, the sealing ring 118 may provide a more reliable sealing than a traditional attachment interface.

In some embodiments, the housing 102 described above may be used with any number of head assemblies 110, where the head assembly 110 shown above is one example. Additionally, the housing 102 may be attached to any number of new or existing head assemblies 110, where the only elements that would need to be replaced are the housing 102, the reset assembly 108 and the reset plunger 122. By incorporating these three new elements, any existing head assemblies may continue to be used, without having to create new head assemblies. In other words, the housing 102, reset assembly 108, and reset plunger 122 may be retrofit onto any number of existing head assemblies.

Figure 2:
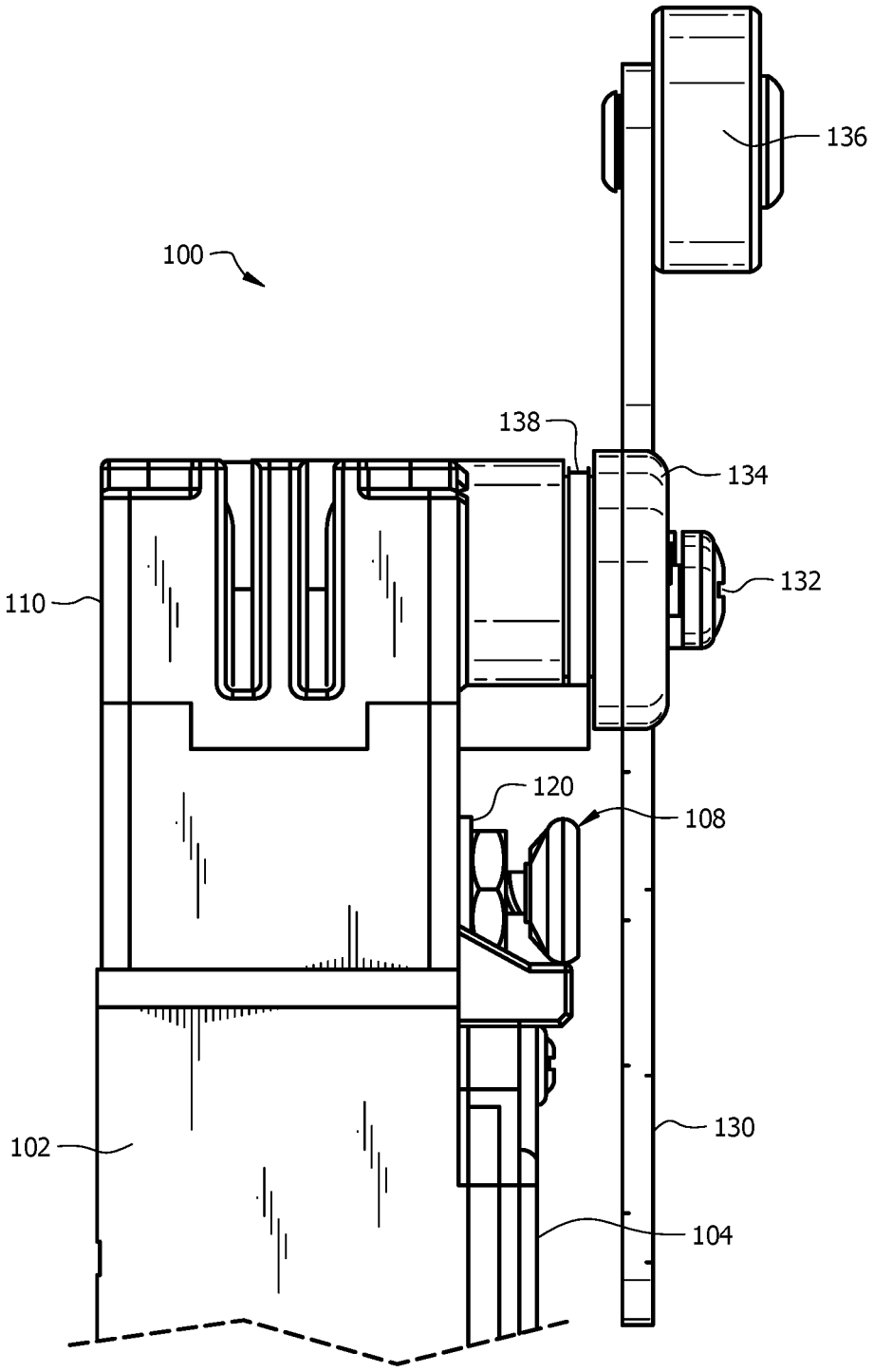
FIG. 2 illustrates a side view of a portion of a limit switch according to an embodiment of the disclosure.

FIG. 2 illustrates a side view of an assembled limit switch 100, wherein the reset assembly 108 is attached directly to the housing 102. The head assembly 110 and the cover assembly 104 are also attached to the housing 102.

Figure 3:
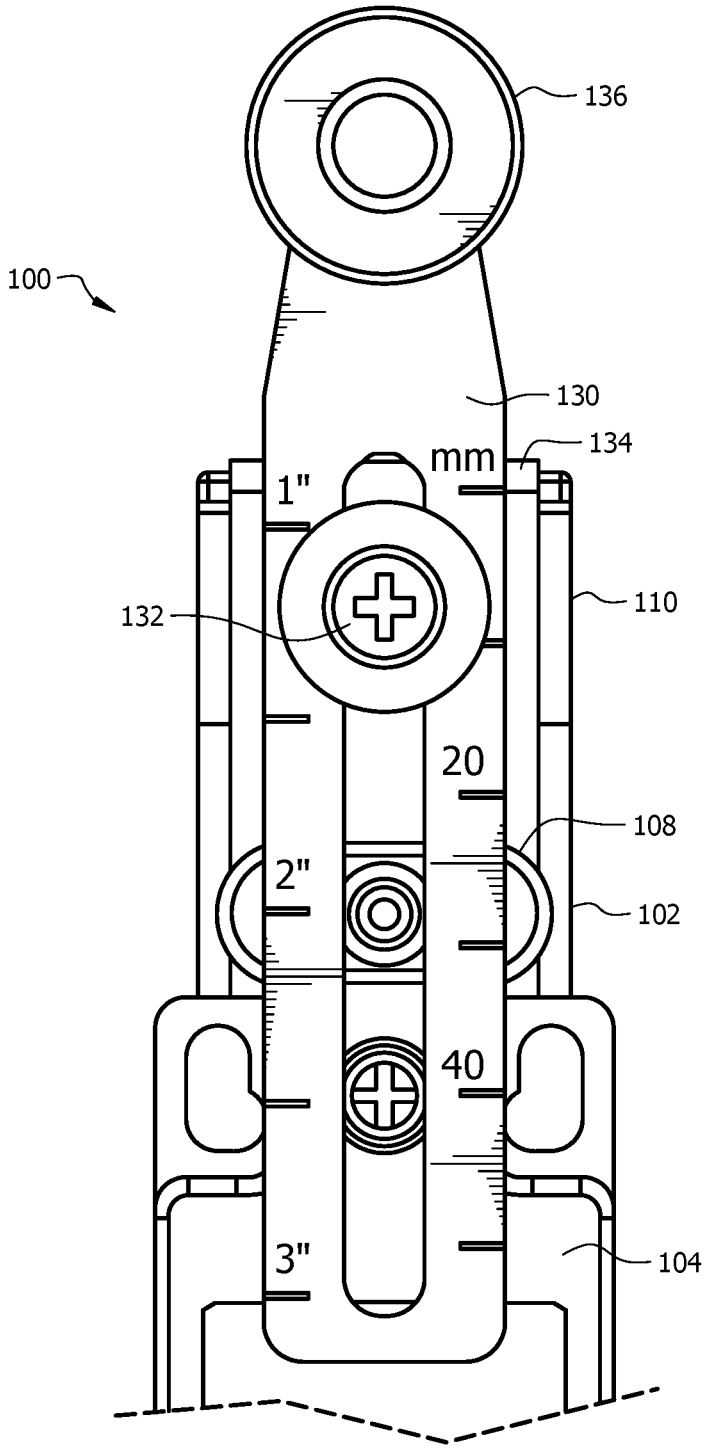
FIG. 3 illustrates a front view of a portion of a limit switch according to an embodiment of the disclosure.

FIG. 3 illustrates a front view of the assembled limit switch 100, wherein the reset assembly 108 is attached directly to the housing 102. The head assembly 110 and the cover assembly 104 are also attached to the housing 102.

Figure 4:
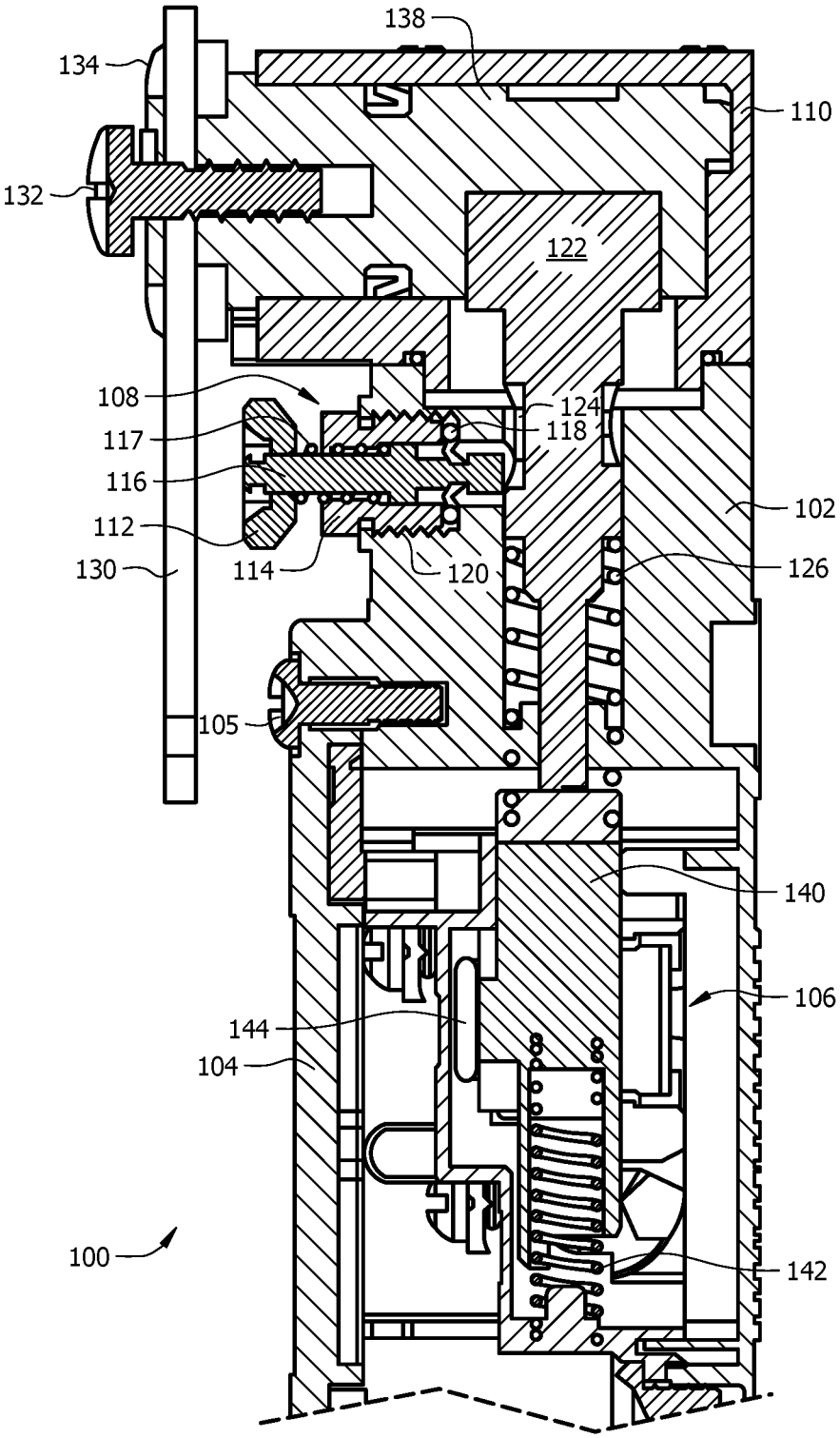
FIG. 4 illustrates a cross-sectional view of a portion of a limit switch according to an embodiment of the disclosure.

FIG. 4 illustrates a cross-sectional view of the assembled limit switch 100, wherein the reset assembly 108 is attached directly to the housing 102. The threaded attachment 114 may be threaded into the opening 120 in the housing 102. The sealing ring 118 of the reset assembly 108 may contact the inner portion of the opening 120, thereby sealing the opening 120. The sealing ring 118 of the reset assembly 108 may seal the internal components located within the housing 102 from the external environment.

The reset axis 116 may be biased toward the interior of the housing 102 by a reset spring 117. The reset button 112 may be attached to the reset axis 116 such that when a user pulls the reset button 112, the reset axis 116 moves away from the interior of the housing 102 against the bias from the reset spring 117. The reset axis 116 of the reset assembly 108 may interact with the reset plunger 122 located within the housing 102. The reset axis 116 may be configured to move into one of the openings 124 of the reset plunger 122 when the opening 124 aligns with the reset axis 116. The reset plunger 122 may interact with the shaft 138 of the head assembly 110, as well as the contact plunger 140 of the contact block assembly 106

When the limit switch 100 is assembled, there may be a compression force between the reset plunger 122 and the contact plunger 140, generated by a contact block spring 142. Additionally, there may be a compression force between the reset plunger 122 and the shaft 138, generated by a plunger spring 126.

The lever 130 of the head assembly may be attached to the shaft 138. When the lever 130 is rotated, moved, shifted, or otherwise impacted due to a measurement taken using the limit switch, the shaft 138 may rotate, pushing the reset plunger 122 downward against the bias of the plunger spring 126. Once the reset plunger 122 has moved downward a predetermined length, the reset axis 116 may align with the opening 124 of the reset plunger 122 and move into the openings 124 due to the bias of the reset spring 117, thereby locking the reset plunger 122 from any other vertical movement. The predetermined length of the reset plunger 122 movement downward may be determined based on the dimensions of the elements of the limit switch 100, the measurements taken using the limit switch 100, and the application details of the limit switch 100. In some embodiments, the predetermined length of the movement of the reset plunger 122 may be approximately 4 millimeters.

When the lever 130 is moved, and the shaft 138 causes the reset plunger 122 to move downward, the reset plunger 122 may also push the contact plunger 140 downward. The movement of the contact plunger 140 may actuate a switch circuit 144 within the contact block assembly 106 from a normally open (NO) contact to normally closed (NC) contact. In other words, when the reset plunger 122 moves downward the predetermined amount, the movement contact plunger 140 may control the switch circuit 144 to switch from a first position to a second position. The actuation of the switch circuit 144 may initiate another action within the limit switch 100, such as activation of an alarm and/or alert, communication that the switch has been actuated, or another similar action.

After the reset axis 116 has locked with the opening 124 of the reset plunger 122, when the reset button 112 is pulled by a user, the reset axis 116 may be released from the opening 124 of the reset plunger 122. Additionally, the lever 130 (and/or other elements of the head assembly 110) may be released and/or returned to an original position. When the lever 130 is released and when the reset button 112 (and therefore the reset axis 116) is released by a user, the reset plunger 122 and the contact plunger 140 will return to their original positions, due to the bias from the contact block spring 142 and the reset spring 117.

Figure 5:
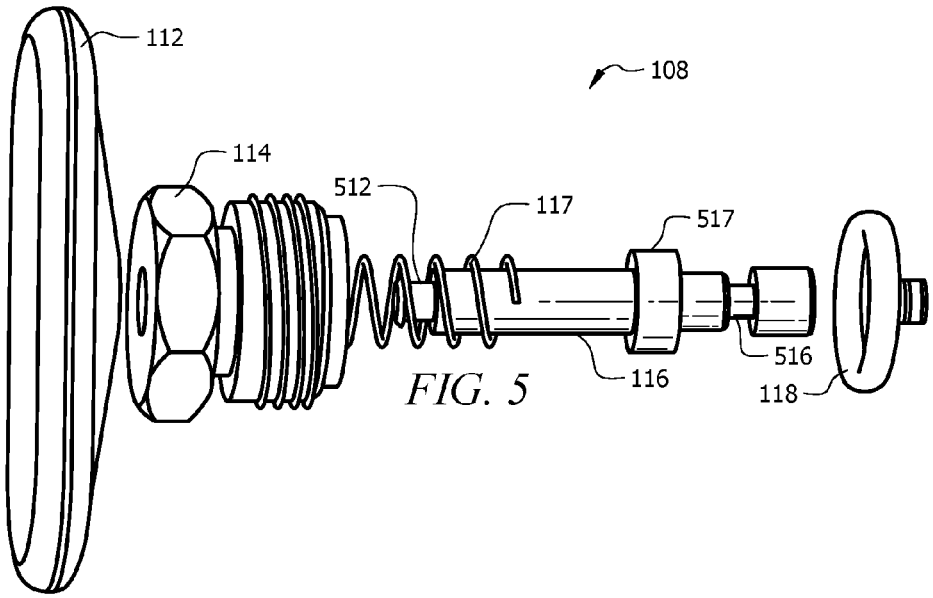
FIG. 5 illustrates an exploded view of a reset assembly for use with a limit switch according to an embodiment of the disclosure.

FIG. 5 illustrates an exploded view of the reset assembly 108, showing the reset button 112, threaded attachment 114, reset spring 117, reset axis 116, and sealing ring 118. In some embodiments, the sealing ring 118 may attach to a notch 516 in the reset axis 116. In some embodiments, the reset spring 117 may be pressed against a raised portion 517 of the reset axis 116. In some embodiments, the reset button 112 may attach to a portion 512 of the reset axis 116.

Figure 6:
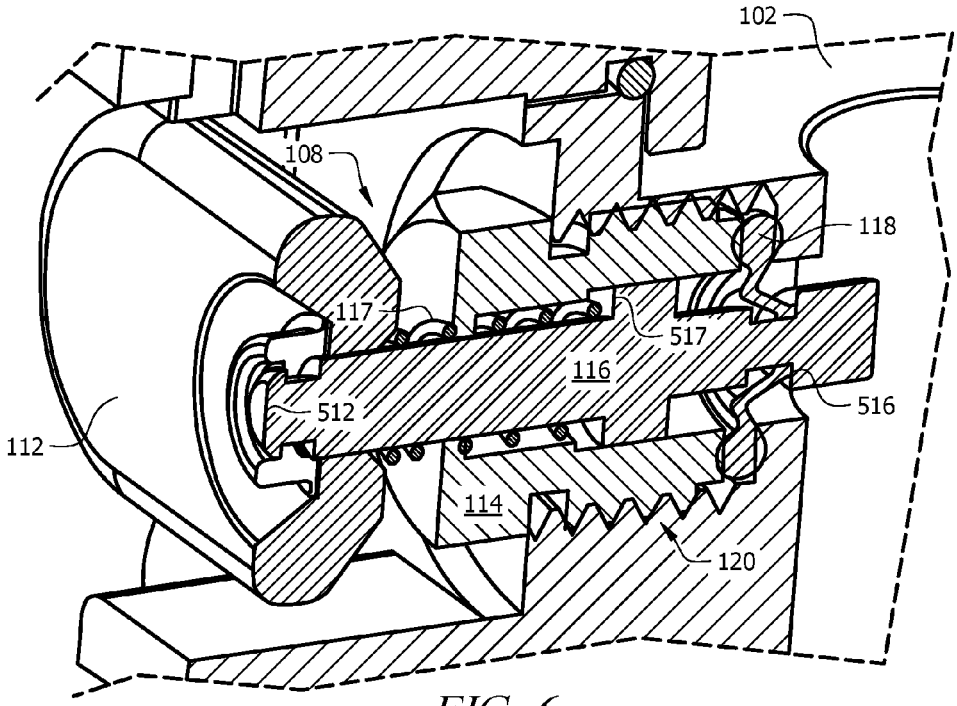
FIG. 6 illustrates a cross-sectional view of a reset assembly for use with a limit switch according to an embodiment of the disclosure.

FIG. 6 illustrates a cross-sectional view of the reset assembly 108 assembled within the opening 120 of the housing 102.

Figure 7:
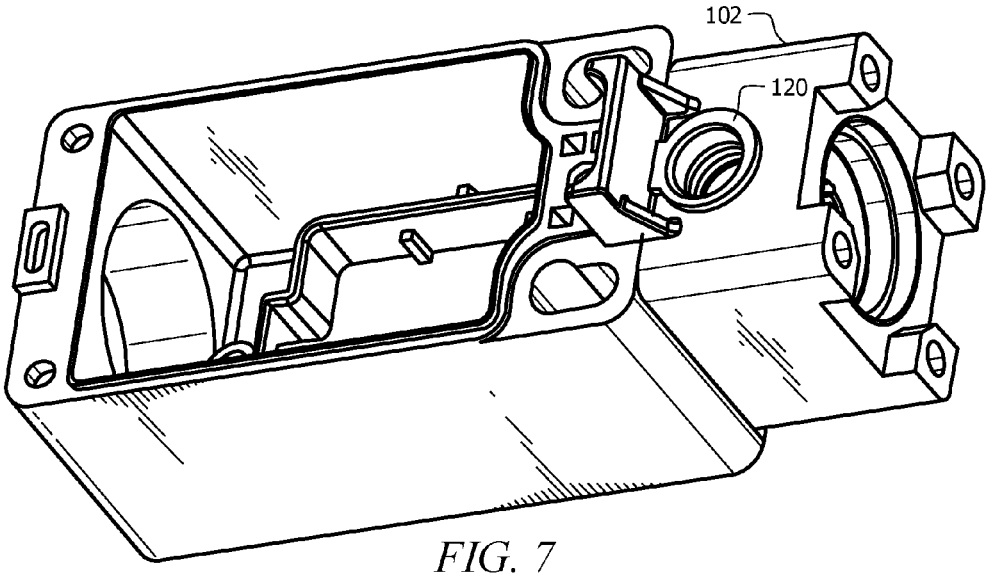
FIG. 7 illustrates a perspective view of a housing for use with a limit switch according to an embodiment of the disclosure.

FIG. 7 illustrates a perspective view of the housing 102 with the opening 120 configured to attach to the reset assembly.

Figure 8:
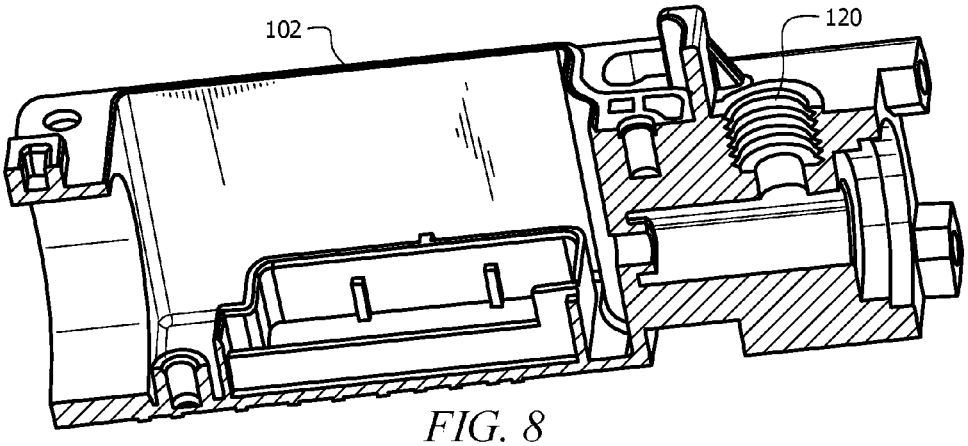
FIG. 8 illustrates a cross-sectional view of a housing for use with a limit switch according to an embodiment of the disclosure.

FIG. 8 illustrates a cross-sectional view of the housing 102 with the opening 120 configured to attach to the reset assembly.

Figure 9A:
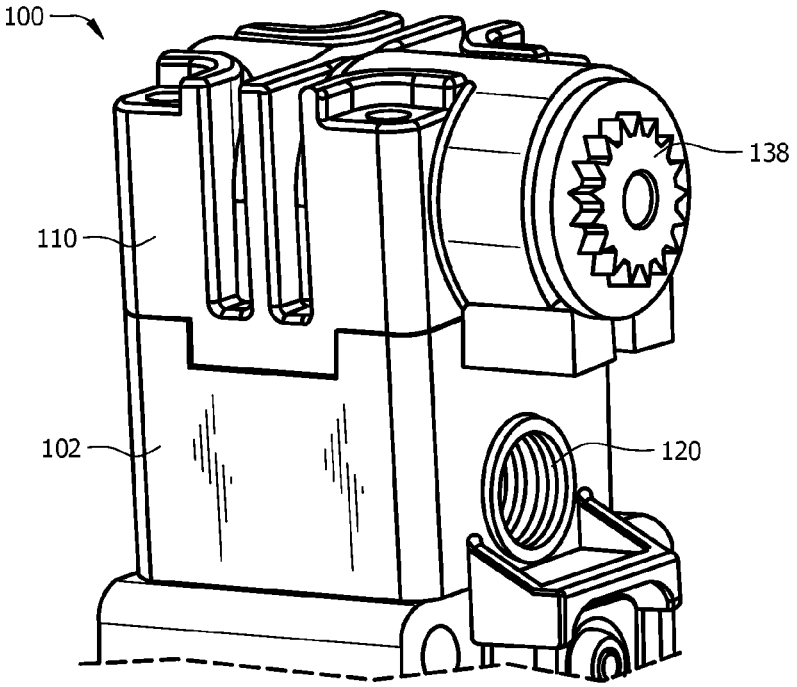
FIGS. 9A-9D illustrate an assembly process of a portion of a limit switch according to an embodiment of the disclosure.
Figure 9B:
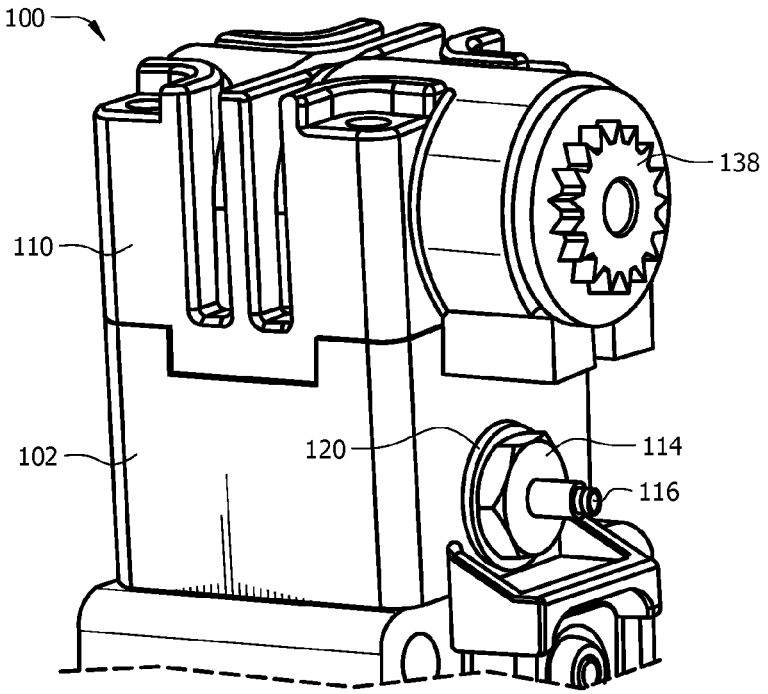
Figure 9C:
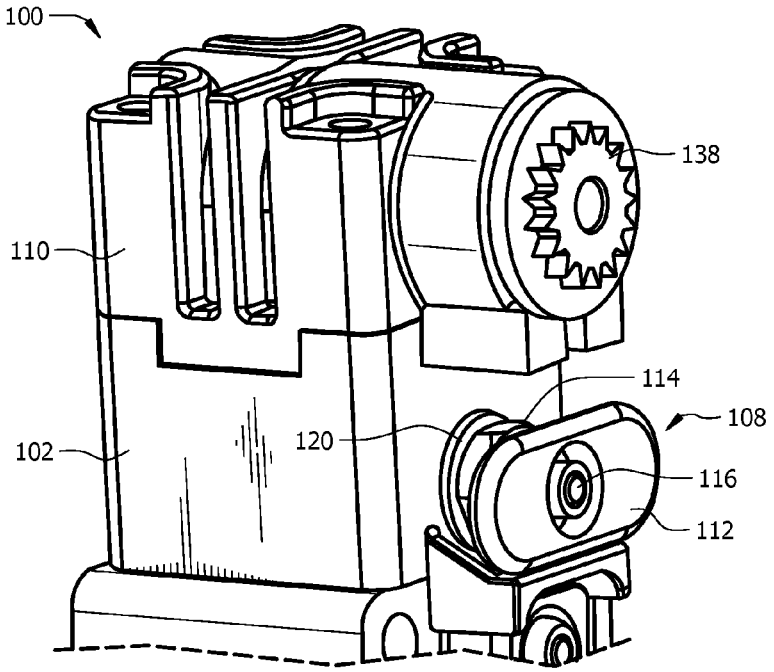
Figure 9D:
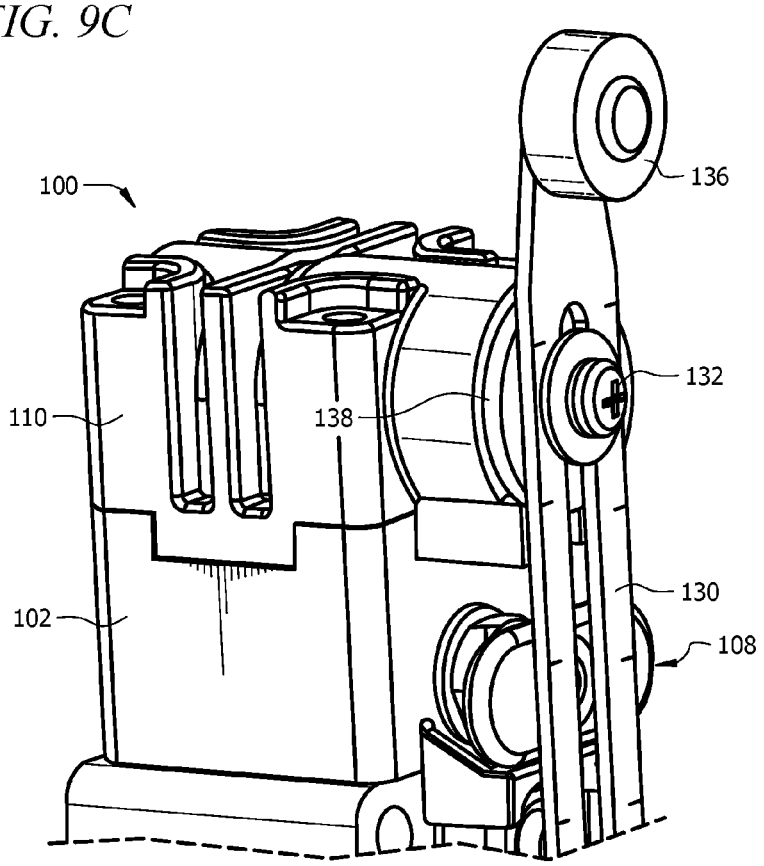

FIGS. 9A-9D illustrate an exemplary assembly process of the limit switch 100. In FIG. 9A, the head assembly 110 may be attached to the housing 102, wherein the head assembly comprises the shaft 138 at least partially extending from the head assembly 110. In FIG. 9B, the threaded attachment 114 and the reset axis 116 (as well as the sealing ring 118 and reset spring 117, not shown) may be attached to the opening 120 of the housing 102. In FIG. 9C, the reset button 112 may be attached to the reset axis 116. In FIG. 9D, the lever 130 (optionally comprising the roller 136) may be attached to the shaft 138 via the screw 132. As shown in FIG. 9D, the head assembly 110 may or may not comprise a bush. In the embodiment shown in FIGS. 9A-9D, the reset button 112 (and the total reset assembly 108) may be located beneath the attachment point between the shaft 138 and the lever 130. In some embodiments, one or more elements of the head assembly 110 may cover the reset assembly 108. For example, the lever 130 may at least partially cover the reset button 112. The lever 130 (and/or other elements of the head assembly 110) may protect the reset button 112 from being pulled or pushed by accident. This may prevent accidental resetting of the limit switch 100.

In a first embodiment, a limit switch may comprise a switch housing; a contact block assembly configured to fit within the switch housing, comprising a contact plunger and a switch circuit; a head assembly comprising a lever, configured to attach to the switch housing; a reset plunger configured to fit within the housing, configured to interact with the head assembly and the contact plunger; and a reset assembly comprising a reset button and a reset axis, wherein the reset assembly is configured to attach to the housing, and wherein the reset axis is configured to interact with the reset plunger, wherein when the lever rotates with respect to the switch housing, a shaft within the head assembly moves the reset plunger downward against a bias, wherein when the reset plunger is moved down a predetermined amount, the reset axis moves into an opening in the reset plunger, due to a bias on the reset axis, wherein when the reset plunger moves downward, the contact plunger also moves downward against a bias, and wherein the contact plunger is configured to control the switch circuit based on the location of the contact plunger within the contact block.

A second embodiment can include the limit switch of the first embodiment, wherein the reset assembly comprises a threaded attachment configured to secure the reset assembly into the housing.

A third embodiment can include the limit switch of the first or second embodiments, wherein the reset assembly attaches to a threaded opening in the switch housing.

A fourth embodiment can include the limit switch of any of the first to third embodiments, wherein the reset assembly comprises a sealing ring configured to seal with the housing.

A fifth embodiment can include the limit switch of any of the first to fourth embodiments, wherein, when assembled, the reset button may be covered by a portion of the head assembly.

A sixth embodiment can include the limit switch of any of the first to fifth embodiments, further comprising a cover assembly configured to attach to the switch housing, and configured to enclose the contact block within the switch housing.

A seventh embodiment can include the limit switch of the sixth embodiment, wherein the cover assembly comprises a user interface.

An eighth embodiment can include the limit switch of any of the first to seventh embodiments, wherein the switch circuit comprises a normally open/normally closed circuit.

A ninth embodiment can include the limit switch of any of the first to eighth embodiments, further comprising a reset spring configured to provide the bias on the reset axis toward the reset plunger.

A tenth embodiment can include the limit switch of any of the first to ninth embodiments, further comprising a contact spring configured to provide the bias on the contact plunger toward the reset plunger.

An eleventh embodiment can include the limit switch of any of the first to tenth embodiments, further comprising a plunger spring configured to provide the bias on the reset plunger toward the head assembly.

A twelfth embodiment can include the limit switch of any of the first to eleventh embodiments, wherein, when the reset button is pulled by a user, the reset axis is removed from the opening in the reset plunger, thereby allowing the reset plunger and the contact plunger to move upward due to the biases.

In a thirteenth embodiment, a method for operating a limit switch may comprise assembling a reset plunger into a housing of the limit switch, between a head assembly of the limit switch and a contact block of the limit switch, wherein the reset plunger interacts with a contact plunger of the contact block; attaching a reset assembly to the housing, wherein the reset assembly interacts with the reset plunger; rotating a shaft of the head assembly to measure physical motion of an object through physical contact between the shaft and the object; moving the reset plunger downward against a bias due to the rotation of the shaft; moving the contact plunger downward against a bias due to the downward movement of the reset plunger; controlling a switch circuit based on the movement of the contact plunger; when the reset plunger is moved downward a predetermined amount, locking the reset plunger in place via the interaction between the reset assembly and the reset plunger; actuating the reset plunger to move upward by pulling the reset assembly away from the reset plunger; moving the reset plunger upward based on the bias; moving the contact plunger upward based on the bias; and controlling the switch circuit based on the movement of the contact plunger.

A fourteenth embodiment can include the method of the thirteenth embodiment, wherein locking the reset plunger in place comprises moving a reset axis of the reset assembly into an opening in the reset plunger.

A fifteenth embodiment can include the method of the fourteenth embodiment, wherein pulling the reset assembly away from the reset plunger comprises pulling a reset button attached to the reset axis, and removing the reset axis from the opening in the reset plunger.

A sixteenth embodiment can include the sensor of any of the thirteenth to fifteenth embodiments, wherein attaching the reset assembly to the housing comprises threading the reset assembly into an opening in the housing.

A seventeenth embodiment can include the sensor of any of the thirteenth to sixteenth embodiments, further comprising activating an alert based on the controlling of the switch circuit.

In an eighteenth embodiment, a limit switch may comprise a housing comprising a threaded opening; a contact block assembly configured to fit within the housing, comprising a contact plunger and a switch circuit; a reset assembly comprising a reset button, a reset axis, and a threaded attachment, wherein the reset assembly is configured to attach to the switch housing via the threaded attachment and the threaded opening; a head assembly comprising a shaft, configured to attach to the switch housing; and a reset plunger configured to contact the shaft and the contact plunger, wherein when a measurement is made by the limit switch, the shaft rotates with respect to the switch housing, moving the reset plunger downward against a bias, wherein when the reset plunger is moved downward a predetermined amount, the reset axis moves into an opening in the reset plunger, due to a bias on the reset axis, wherein when the reset plunger moves downward, the contact plunger also moves downward against a bias, wherein the contact plunger is configured to control the switch circuit based on the location of the contact plunger within the contact block, and wherein when the reset button is pulled by a user, the reset axis is removed from the opening in the reset plunger, thereby releasing the reset plunger and the contact plunger to move upward due to the biases.

A nineteenth embodiment can include the limit switch of the eighteenth embodiment, wherein the contact block is configured to activate an alert based on the controlling of the switch circuit.

A twentieth embodiment can include the limit switch of the eighteenth or nineteenth embodiments, wherein the reset assembly comprises a sealing ring configured to seal with the threaded opening of the housing.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of." Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A limit switch comprising:

a housing comprising a threaded opening;

a contact block assembly configured to fit within the housing, comprising a contact plunger and a switch circuit;

a reset assembly comprising a reset button, a reset axis, and a threaded attachment, wherein the reset assembly is configured to attach to the switch housing via the threaded attachment and the threaded opening;

a head assembly comprising a shaft, configured to attach to the switch housing; and a reset plunger configured to contact the shaft and the contact plunger, wherein:

when a measurement is made by the limit switch, the shaft rotates with respect to the switch housing, moving the reset plunger downward against a bias, when the reset plunger is moved downward a predetermined amount, the reset axis moves into an opening in the reset plunger, due to a bias on the reset axis, when the reset plunger moves downward, the contact plunger also moves downward against a bias, the contact plunger is configured to control the switch circuit based on the location of the contact plunger within the contact block, and when the reset button is pulled by a user, the reset axis is removed from the opening in the reset plunger, thereby releasing the reset plunger and the contact plunger to move upward due to the biases.

2. The limit switch of claim 1, wherein the contact block is configured to activate an alert based on the controlling of the switch circuit.

3. The limit switch of claim 1, wherein the reset assembly comprises a sealing ring configured to seal with the threaded opening of the housing.

4. A limit switch comprising:

a switch housing;

a contact block assembly configured to fit within the switch housing, comprising a contact plunger and a switch circuit;

a head assembly comprising a lever, configured to attach to the switch housing;

a reset plunger configured to fit within the housing, configured to interact with the head assembly and the contact plunger; and a reset assembly comprising a reset button and a reset axis, wherein the reset assembly is configured to attach to the housing, and wherein the reset axis is configured to interact with the reset plunger, wherein:

when the lever rotates with respect to the switch housing, a shaft within the head assembly moves the reset plunger downward against a bias, when the reset plunger is moved down a predetermined amount, the reset axis moves into an opening in the reset plunger, due to a bias on the reset axis, when the reset plunger moves downward, the contact plunger also moves downward against a bias, and the contact plunger is configured to control the switch circuit based on the location of the contact plunger within the contact block.

5. The limit switch of claim 4, wherein the reset assembly comprises a threaded attachment configured to secure the reset assembly into the housing.

6. The limit switch of claim 4, wherein the reset assembly attaches to a threaded opening in the switch housing.

7. The limit switch of claim 4, wherein the reset assembly comprises a sealing ring configured to seal with the housing.

8. The limit switch of claim 4, wherein, when assembled, the reset button may be covered by a portion of the head assembly.

9. The limit switch of claim 4, wherein the switch circuit comprises a normally open/normally closed circuit.

10. The limit switch of claim 4, further comprising a reset spring configured to provide the bias on the reset axis toward the reset plunger.

11. The limit switch of claim 4, further comprising a contact spring configured to provide the bias on the contact plunger toward the reset plunger.

12. The limit switch of claim 4, further comprising a plunger spring configured to provide the bias on the reset plunger toward the head assembly.

13. The limit switch of claim 4, wherein, when the reset button is pulled by a user, the reset axis is removed from the opening in the reset plunger, thereby allowing the reset plunger and the contact plunger to move upward due to the biases.

14. The limit switch of claim 4, further comprising a cover assembly configured to attach to the switch housing, and configured to enclose the contact block within the switch housing.

15. The limit switch of claim 14, wherein the cover assembly comprises a user interface.

16. A method for operating a limit switch comprising:

assembling a reset plunger into a housing of the limit switch, between a head assembly of the limit switch and a contact block of the limit switch, wherein the reset plunger interacts with a contact plunger of the contact block;

attaching a reset assembly to the housing, wherein the reset assembly interacts with the reset plunger;

rotating a shaft of the head assembly to measure physical motion of an object through physical contact between the shaft and the object;

moving the reset plunger downward against a bias due to the rotation of the shaft;

moving the contact plunger downward against a bias due to the downward movement of the reset plunger;

controlling a switch circuit based on the movement of the contact plunger;

when the reset plunger is moved downward a predetermined amount, locking the reset plunger in place via the interaction between the reset assembly reset axis and an opening in the reset plunger;

actuating the reset plunger to move upward by pulling the reset assembly away from the reset plunger;

moving the reset plunger upward based on the bias;

moving the contact plunger upward based on the bias; and controlling the switch circuit based on the movement of the contact plunger.

17. The method of claim 16, wherein attaching the reset assembly to the housing comprises threading the reset assembly into an opening in the housing.

18. The method of claim 16, further comprising activating an alert based on the controlling of the switch circuit.

19. The method of claim 16, wherein locking the reset plunger in place comprises moving a reset axis of the reset assembly into an opening in the reset plunger.

20. The method of claim 19, wherein pulling the reset assembly away from the reset plunger comprises pulling a reset button attached to the reset axis, and removing the reset axis from the opening in the reset plunger.

* * * * *